United States Patent [19]

Hyyppä

[11] Patent Number: 4,642,147

[45] Date of Patent: Feb. 10, 1987

[54] HIGH ENERGY COMPOSITION

[75] Inventor: Juho Hyyppä, Rauma, Finland

[73] Assignee: Raikka Oy, Helsinki, Finland

[21] Appl. No.: 740,830

[22] Filed: Jun. 3, 1985

[30] Foreign Application Priority Data

Jun. 19, 1984 [FI] Finland ..... 842470

[51] Int. Cl.[4] ..... C06B 45/10

[52] U.S. Cl. ..... 149/19.9; 149/22; 149/42; 149/44; 149/85

[58] Field of Search ..... 149/42, 43, 70, 85, 149/19.9, 22, 44

[56] References Cited

U.S. PATENT DOCUMENTS

| | | | |
|---|---|---|---|
| 3,475,237 | 10/1969 | Lane et al. | 149/70 |
| 3,704,187 | 11/1972 | Kott et al. | 149/70 |
| 3,706,617 | 12/1972 | Hastings | 149/70 |

*Primary Examiner*—Stephen J. Lechert, Jr.

*Attorney, Agent, or Firm*—Donald D. Mon

[57] ABSTRACT

High energy composition which is meant for propellants, pyrotechnical and technical compositions, explosives or corresponding items, and production method.

5 Claims, No Drawings

HIGH ENERGY COMPOSITION

BACKGROUND OF THE INVENTION

The object of this invention is a high energy composition, which is meant for propellants, pyrotechnical compositions, explosives or corresponding items, in which composition as fuel there is used fine particle sized aluminum or composition and/or alloy of aluminum and magnesium, in which aluminum is being oxidized at low temperatures into aluminum oxide $Al_2O_3$ and magnesium oxide MgO by means of a basic oxidizer, such as different kinds of nitrates, perchlorates, oxides and explosives containing oxygen.

The object of this invention also is the method of production of the composition in question.

DETAILED DESCRIPTION OF THE INVENTION

In high energy compositions the creating of the highest possible chemical combustion energy is based either partly or wholly on metal powders, as for example, aluminum or magnesium, oxidizing into an oxide ($Al_2O_3$, MgO). As an oxidizer there are often used different nitrates and perchlorates, such as, for example, $NaNO_3$, $KNO_3$, $LiNO_3$, $NaClO_4$, $KClO_4$, $LiClO_4$ or explosives containing oxygen, such as for example, organic nitroesters, RDX and PETN as well as different oxides, for example $Fe_3O_4$.

It is generally known that the combustion of aluminum in this kind of composition is more or less incomplete also in stoichiometric compositions, when aluminum content is high, for example, more than 25%-by-weight and especially, when combustion takes place in air (1 atm pressure). Instead magnesium is oxidized more completely in corresponding conditions. It is known that the chemical properties of an oxidizer will have clearly different kinds of effects on oxidizing of different metals. In addition each processing technique, for example, casting or pressing, will influence the choice of metal. In general aluminum is used in cast compositions, such as rocket propellants, in which the strength properties of a mass are produced by a cured polymer binder. Then the benefit of aluminum is its great density (2.7 g/m$^3$), spherical form (atomized) also in the extremely small grain size (below 10 m) and the high chemical combustion energy per mass unit. Regarding these compositions the maximum content of aluminum normally is less than 25%-by-weight, for example, when ammonium perchlorate is used as an oxidizer. Within this concentration range and at relatively high pressure (100–200 atm) the oxidizing of aluminum will be done well enough.

Concerning pressed masses, the use of magnesium is very common, for example, flare masses, the combustion of which occurs in air. Then the most important benefit of magnesium is its perfect combustion also in high concentrations (>25%-by-weight), especially when sodium nitrate is used as an oxidizer. A disadvantage is that MgO, a product of combustion, has a tendency to decompose at very high temperatures (>3000° C.).

For safety reasons and due to facility of production technology the trend nowadays is toward cast masses. The ignition sensitivity of masses in the pressing stage imposes definite limits for the size of a pressed piece.

On trying to increase aluminum content in above mentioned mass types, the problem in compositions of over 25%-by-weight is the incomplete combustion of aluminum.

The objective of this invention is to create a high energy composition, in which aluminum is to be combusted perfectly also in high concentrations, i.e. from over 25%-by-weight to 50%-by-weight.

The objective of this invention will be attained by a high energy composition, which is characterized mainly in that in the composition there is stoichiometrically too little oxygen for oxidizing aluminum Al and magnesium Mg into aluminum oxide $Al_2O_3$ and magnesium oxide MgO, or for just oxidizing aluminum Al into aluminum oxide $Al_2O_3$, so that part of the aluminum will be oxidized into aluminum suboxide ($Al_2O$) at a temperature of over 2200° C.

Mainly characteristic of the method of this invention is, that in regard to $Al_2O$ and/or MgO there is used an underoxidized composition, so that part of aluminum will be oxidized into aluminum suboxide $Al_2O$ at a temperature of over 2200° C.

The method of this invention is based on following experiences:

1. Magnesium will be oxidized into oxide at a lower temperature than aluminum. At the highest temperatures magnesium oxide acts as a secondary oxidizer for aluminum and for the carbon of a binder that is in the composition, and will oxidize aluminum into $Al_2O$ and carbon into CO, and 2. A perchlorate type high energy oxidizer decomposes spontaneously without any reaction with the metal fuels. Thus a greater part of the aluminum has time to heat up without being oxidized up to a higher temperature (>2200° C.), at which the oxidizing directly into $Al_2O$ takes place. The decomposition temperature of an oxidizer can be reduced by suitable catalysts, for example by adding a little manganese metal powder into the composition which improves spreading of the aluminum powder into a gaseous reaction zone.

3. In the composition it is also possible to use 0–10%-by-weight boron (B), which acts as a stabilizer for aluminum oxide at the highest temperatures reacting with the oxygen that is transformed in decomposition of aluminum oxide. In addition, formed boric oxide ($B_2O_3$) advances the forming of $Al_2O$ by reacting in a temperature range of over 2000° C. according to following equation:

$$\tfrac{1}{2}Al_2O\ (gas) + \tfrac{1}{2}B_2O_3\ (gas) \rightarrow AlBO_2\ (gas)$$

With the high energy composition of this invention numerous important advantages will be achieved. Since aluminum (Al) can be oxidized at low temperatures into $Al_2O_3$ and at high temperatures into $Al_2O$, the formation heat of which at high temperatures per oxygen is about the same as $Al_2O_3$ has, such compositions can be made in which the fuel content (Al, Mg, B) can rise up to 60%-by-weight, when the chemical energy of the composition increases in the same proportion. Thus it essentially increases, for example, impulse concerning rocket propellants using a perchlorate oxidizer (especially $LiClO_4$) and aluminum and boron as fuel. Regarding flare masses, in which magnesium (Mg) is a mainly used fuel, adding aluminum and its consequent oxidizing at a high temperature into a very energetic $Al_2O$-gas increases light output and illuminance.

Below the invention is explained more in detail.

The oxidizing power of metals at different temperatures can be scrutinized by comparing values of corresponding oxides' free energy (G) at the temperatures in question. In order to enable reaction, the value of G must be negative at the temperature in question. At temperatures below 1300° C. the free energy of MgO is more negative than the same of $Al_2O_3$ per oxygen atom. Within this temperature range Mg has a greater ability to oxidize than Al has, being even about three times greater. Within the temperature range of over 1300° C. the situation is opposite. Within the temperature range of over 2200° C. aluminum has a greater tendency to be oxidized into gaseous $Al_2O$ than to liquid $Al_2O_3$. The point of this invention is, that the circumstances of practice can be made such that aluminum will be oxidized selectively into $Al_2O$ at high temperatures. Adding of boron (B) into the composition improves forming of $Al_2O$, because boric oxide $B_2O_3$ reacts with $Al_2O$ forming $AlBO_2$-gas. In addition the reaction is a little exothermic ($H_{2200} = -15$ kcal/mole). The use of boron is advantageous in a rocket propellant mass, where there is no magnesium as fuel. As the formed $AlBO_2$ is a gas, by adding boron the formation of visible smoke can be reduced.

The development work of aluminum fueled flare mass has led to this invention. In this work we were met by the fact, that on using magnesium and aluminum together and on the other hand on using only aluminum as fuel, together with perchlorate oxdizers the illumination properties disappeared compared with a magnesium/sodium nitrate flare mass. The reason is just the formation of $Al_2O$ and not of $Al_2O_3$, which was hypothetical. The changing of the oxidizing mechanism of aluminum at the highest temperatures will not appear in connection with normal calorimetric measurements, because the formation heats of $Al_2O$ and $Al_2O_3$ per oxygen atom do not much differ from each other in practice measuring conditions.

EXAMPLE 1

(Percentages by weight)

| Flare mass 1 | | Flare mass 2 (comparison) | |
|---|---|---|---|
| Mg (coarse particle size) | 24.0 | Mg (coarse particle size) | 53.0 |
| Al/Mg (50:50) alloy | 29.0 | | |
| $NaNO_3$ | 37.0 | $NaNO_3$ | 37.0 |
| $LiClO_4$ | 5.0 | $LiClO_4$ | 5.0 |

-continued

| Flare mass 1 | | Flare mass 2 (comparison) | |
|---|---|---|---|
| Binder | 5.0 | Binder | 5.0 |

The illumination efficiency of flare mass 1 was 64.000 cd.s/g and burning rate 2.8 mm/s.

Flare mass 2 was similar, except that Al/Mg alloy had been replaced by magnesium and its illumination efficiency was 47,700 cd.s/g and burning rate 4.3 mm/s.

EXAMPLE 2

(Percentages by weight)

| | |
|---|---|
| $LiClO_4$ | 48.0 |
| Al (atomized extra fine particle size) | 37.0 |
| B | 3.0 |
| Binder (for example, hydroxyterminated polybutadiene) | 12.0 |

A composition like this gives a very high specific impulse for a rocket propellant. Adding the amount of boron increases the amount of $AlBO_2$-gas, and the amount of $Al_2O_3$ decreases in the reaction products. Then also the amount of visible smoke will decrease.

I claim:

1. A propellant composition intended to react only with its own components and not with atmospheric oxygen during its propulsive reaction, comprising:

finely divided aluminum metal as a fuel, and lithium perchlorate or a mixture of lithium perchlorate and ammonium perchlorate as an oxidizer, said aluminum being present by weight percentage between about 25% and about 50%, and the oxidizer and any other oxygen containing substance in the composition being present in stoichiometric proportion to provide too little oxygen to oxidize all of the aluminum to aluminum oxide, but sufficient to oxidize all of it at least to aluminum suboxide at a temperatures in excess of 2,200 degrees C.

2. A propellant according to claim 1 in which the oxidizer is lithium perchlorate.

3. A propellant composition according to claim 1 in which boron metal is included by weight percentage between zero percent and about 10%.

4. A propellant composition comprising, by weight percentage: finely divided aluminum metal about 37%; lithium perchlorate, about 48%; boron metal, about 3%; and an organic binder, about 12%.

5. A propellent composition according to claim 4 in which said binder is hydroxyterminated polybutadiene.

* * * * *